US010124987B2

(12) United States Patent
Shibata et al.

(10) Patent No.: US 10,124,987 B2
(45) Date of Patent: Nov. 13, 2018

(54) ELEVATOR DEVICE

(71) Applicant: Mitsubishi Electric Corporation, Chiyoda-ku (JP)

(72) Inventors: Masunori Shibata, Tokyo (JP); Takuo Kugiya, Tokyo (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 0 days.

(21) Appl. No.: 15/324,038

(22) PCT Filed: Sep. 9, 2014

(86) PCT No.: PCT/JP2014/073786

§ 371 (c)(1),
(2) Date: Jan. 5, 2017

(87) PCT Pub. No.: WO2016/038681

PCT Pub. Date: Mar. 17, 2016

(65) Prior Publication Data

US 2017/0217724 A1 Aug. 3, 2017

(51) Int. Cl.
*B66B 1/32* (2006.01)
*B66B 1/34* (2006.01)
(Continued)

(52) U.S. Cl.
CPC ..... *B66B 1/32* (2013.01); *B66B 1/3476* (2013.01); *B66B 5/06* (2013.01); *B66B 5/18* (2013.01); *B66B 9/00* (2013.01)

(58) Field of Classification Search
CPC ..... B66B 1/32; B66B 1/285; B66B 5/0031; B66B 1/3492; B66B 5/04; B66B 5/16;
(Continued)

(56) References Cited

U.S. PATENT DOCUMENTS

2009/0133964 A1* 5/2009 Ueda ..... B66B 5/02 187/254
2009/0255762 A1* 10/2009 Ketonen ..... B66B 13/22 187/247

(Continued)

FOREIGN PATENT DOCUMENTS

CN 1950287 A 4/2007
CN 101065311 A 10/2007

(Continued)

OTHER PUBLICATIONS

Office Action dated Jul. 25, 2017 in Japanese Patent Application No. 2016-547289 (with partial English language translation).

(Continued)

*Primary Examiner* — Marlon Fletcher
(74) *Attorney, Agent, or Firm* — Oblon, McClelland, Maier & Neustadt, L.L.P.

(57) ABSTRACT

An elevator device includes: a controller and an emergency terminal speed-limiting device to decelerate a car when speed of the car within a predetermined certain distance from an terminal end section of a shaft is detected to have reached or exceeded an overspeed reference. The overspeed reference is set smaller as a distance of the car from the terminal end section of the shaft decreases. The controller includes: a lower deceleration limit determination controller to determine a lower deceleration limit at which the speed of the car is caused to be at or below the overspeed reference, based on a position and a speed of the car within the certain distance from the terminal end section of the shaft, and a deceleration controller to control deceleration of the car within the certain distance, in a range greater than the lower deceleration limit determined by the lower deceleration limit determination unit.

6 Claims, 3 Drawing Sheets

(51) Int. Cl.
*B66B 5/06* (2006.01)
*B66B 5/18* (2006.01)
*B66B 9/00* (2006.01)

(58) Field of Classification Search
CPC ..... B66B 5/00; B66B 5/0018; B66B 1/36; H02H 7/0833
See application file for complete search history.

(56) References Cited

U.S. PATENT DOCUMENTS

| | | | | |
|---|---|---|---|---|
| 2009/0288920 | A1* | 11/2009 | Kattainen | B66B 5/04 187/287 |
| 2010/0170751 | A1* | 7/2010 | Hashimoto | B66B 1/32 187/288 |
| 2010/0258382 | A1* | 10/2010 | Kondo | B66B 1/32 187/288 |
| 2011/0011681 | A1* | 1/2011 | Kondo | B66B 1/32 187/247 |
| 2015/0075915 | A1* | 3/2015 | Stolt | B66B 1/30 187/247 |
| 2015/0336768 | A1* | 11/2015 | Otsuka | B66B 1/3492 187/394 |
| 2016/0152440 | A1* | 6/2016 | Hopp | B66B 29/00 198/323 |

FOREIGN PATENT DOCUMENTS

| | | | |
|---|---|---|---|
| EP | 1864936 | A1 | 12/2007 |
| EP | 1930277 | A1 | 6/2008 |
| JP | 2003-238037 | A | 8/2003 |
| JP | 2004-123279 | A | 4/2004 |
| JP | 2005-280934 | A | 10/2005 |
| JP | 2014-51344 | A | 3/2014 |
| KR | 10-2007-0069127 | A | 7/2007 |
| KR | 10-2007-0097042 | A | 10/2007 |
| WO | 2006/103768 | A1 | 10/2006 |
| WO | 2007/039927 | A1 | 4/2007 |

OTHER PUBLICATIONS

International Search Report dated Nov. 25, 2014, in PCT/JP2014/073786, filed Sep. 9, 2014.
International Preliminary Report on Patentability and Written Opinion dated Mar. 23, 2017 in PCT/JP2014/073786 (submitting English language translation only).
Korean Office Action dated May 18, 2018 in Korean Patent Application No. 10-2017-7000951 (with unedited computer generated English translation), 9 pages.
Combined Office Action and Search Report dated May 17, 2018 in Chinese Patent Application No. 201480081107.1 (with English translation).

* cited by examiner

ELEVATOR DEVICE

FIELD

The present invention relates to an elevator device.

BACKGROUND

Conventionally, there is known an elevator device including a car that runs in a shaft of an elevator, and a counterweight that ascends or descends in the shaft in the opposite direction from the car, the elevator device being configured to drive the car at least a plurality of constant speeds, and at a variable highest speed and a variable acceleration/deceleration, which are a plurality of accelerations/decelerations, where a car buffer and a counterweight buffer provided in a shaft pit are set based on a maximum highest speed of the car (for example, see PTL 1).

Furthermore, conventionally, there is known an elevator device including a car that runs in a shaft of an elevator, and a counterweight that ascends or descends in the shaft in the opposite direction from the car, the elevator device being configured to drive the car at least a plurality of constant speeds and at a variable highest speed and a variable acceleration/deceleration, which are a plurality of accelerations/decelerations, where there is provided forced speed reduction means for changing a highest speed at a time of the car running within a certain distance from a terminal end of the shaft to a highest speed at a shaft terminal end section, and where a car buffer and a counterweight buffer provided in a shaft pit are set based on the highest speed of the car at the shaft terminal end section (for example, see PTL 1 likewise).

CITATION LIST

Patent Literature

[PTL 1] JP 2005-280934 A

SUMMARY

Technical Problem

However, according to the conventional elevator device disclosed in PTL 1, the specifications of a buffer installed in the shaft pit, that is, at a bottom section of the shaft, are set according to the maximum highest speed, and a long buffer with a buffer stroke that is longer as the maximum highest speed is increased is required. Also, the pit at the bottom section of the shaft has to be dug deeper to accommodate the buffer, and the space occupied by the elevator device in a building is increased.

Also, in the case where the highest speed of the car running within a certain distance from the terminal end of the shaft is limited to a low speed by the forced speed reduction means, a buffer with a short buffer stroke becomes applicable, but because the highest speed, which greatly affects operational efficiency, is reduced, the operational efficiency and the convenience are reduced.

The present invention has been made to solve the problems as described above, and is to provide an elevator device according to which no particular limit is set on a highest speed of a car running at a terminal end section of a shaft toward a terminal floor (the top floor or the bottom floor), and to which a buffer with a short buffer stroke is made applicable, where the operational efficiency and the convenience are prevented from being reduced, and a space occupied by the elevator device in a building is prevented from being increased.

Solution to Problem

An elevator device according to the present invention includes: a car and a counterweight that ascend or descend in a shaft of an elevator in opposite directions from each other; control means configured to control ascending/descending of the car at a variable highest speed and a variable acceleration/deceleration allowing a highest speed and an acceleration/deceleration at a time of running of the car to be changed; a car buffer provided at a bottom section of the shaft, the car buffer configured to prevent the car from colliding into the bottom section; a weight buffer provided at the bottom section of the shaft, the weight buffer configured to prevent the counterweight from colliding into the bottom section; and emergency terminal speed-limiting means configured to decelerate the car by force when a speed of the car within a predetermined certain distance from an upper or lower terminal end section of the shaft is detected to have reached or exceeded an overspeed reference. The overspeed reference is set to be smaller as a distance of the car from the upper or lower terminal end section of the shaft is shorter. The control means includes: lower deceleration limit determination means configured to determine a lower deceleration limit at which the speed of the car is caused to be at or below the overspeed reference, based on a position and a speed of the car within the certain distance from the upper or lower terminal end section of the shaft, and deceleration control means configured to control deceleration of the car within the certain distance from the upper or lower terminal end section of the shaft, in a range greater than the lower deceleration limit determined by the lower deceleration limit determination means.

Advantageous Effects of Invention

The elevator device according to the present invention achieves effects that no particular limit is set on a highest speed of a car running at a terminal end section of a shaft toward a terminal floor (the top floor or the bottom floor), that a buffer with a short buffer stroke is made applicable, that the operational efficiency and the convenience are prevented from being reduced, and that a space occupied by the elevator device in a building is prevented from being increased.

DESCRIPTION OF EMBODIMENTS

Figure 1:
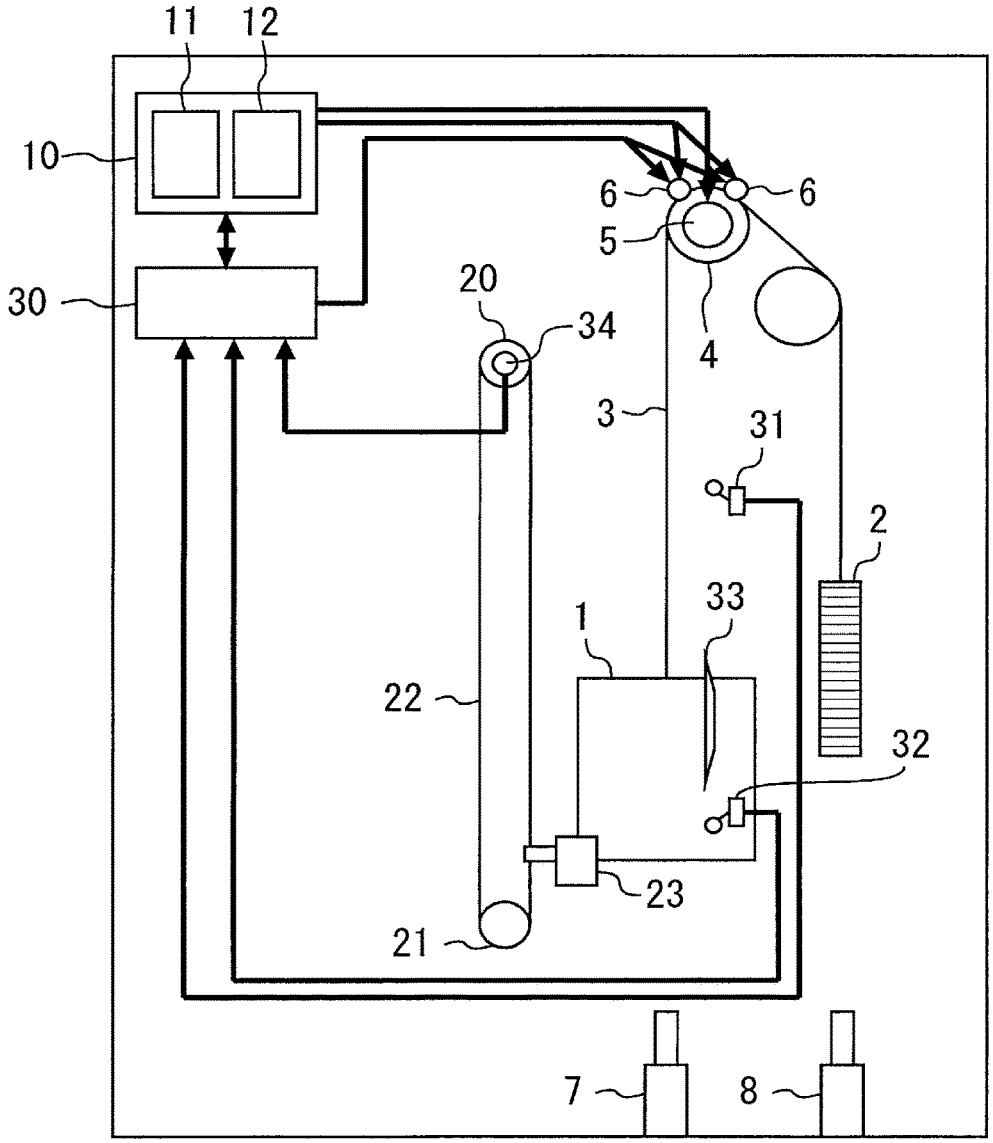
FIG. 1 is a diagram schematically showing the overall configuration of an elevator device related to a first embodiment of the present invention.

The present invention will be described with reference to the appended drawings. In the drawings, the same reference signs indicate the same or corresponding parts, and redundant description will be simplified or omitted as appropriate.

First Embodiment

Figure 2:
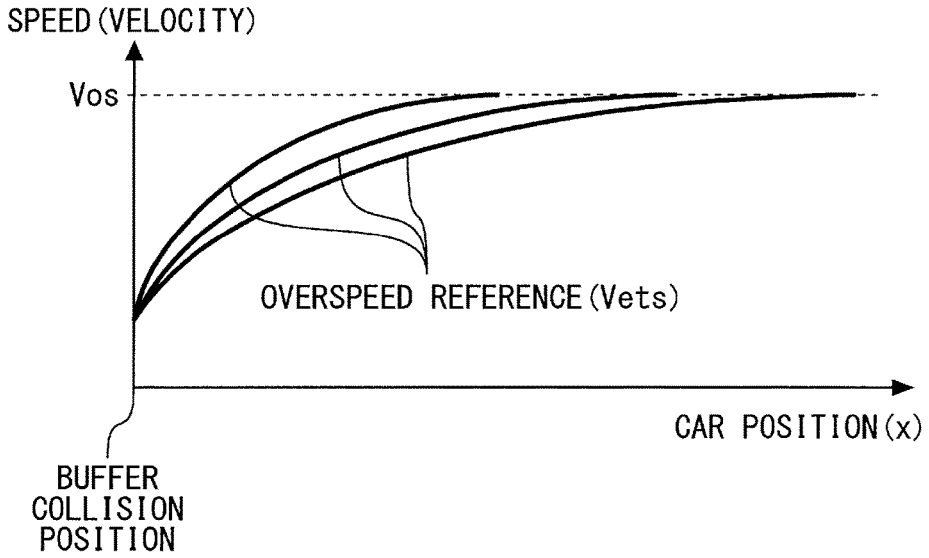
FIG. 2 is a diagram showing a setting of an overspeed reference by an emergency terminal speed-limiting device provided to the elevator device related to the first embodiment of the present invention.

FIGS. 1 and 2 are related to a first embodiment of the present invention, and FIG. 1 is a diagram schematically showing the overall configuration of an elevator device, and FIG. 2 is a diagram showing a setting of an overspeed reference by an emergency terminal speed-limiting device provided to the elevator device.

As shown in FIG. 1, a car 1 is installed inside a shaft of an elevator. The car 1 ascends or descends in the shaft by being guided by a guide rail, not shown. One end of a main rope 3 is coupled to an upper end of the car 1. The other end of the main rope 3 is coupled to an upper end of a counterweight 2. The counterweight 2 is installed in the shaft in a manner capable of freely ascending and descending.

A middle section of the main rope is wound around a driving sheave of a traction machine 4 installed at a top section of the shaft. In this manner, the car 1 and the counterweight 2 are hung like well buckets by the main rope 3 to ascend or descend in opposite directions from each other in the shaft.

The traction machine 4 includes a motor 5 and a brake 6. The motor 5 is for generating a driving torque for the driving sheave of the traction machine 4. On the other hand, the brake 6 is for generating a braking torque for the driving sheave of the traction machine 4.

In order to control ascending/descending, that is, running and stopping of the car 1, a control device 10 controls operations of the motor 5 and the brake 6. The control device 10 controls ascending/descending of the car 1 based on a variable highest speed and a variable acceleration/deceleration. The variable highest speed means that the highest speed of the car 1 at the time of running can be changed. Also, the variable acceleration/deceleration means that the acceleration/deceleration at the time of running of the car 1 can be changed.

That is, the control device 10 sets each of the highest speed and the acceleration/deceleration of the car 1 to an optimal value within an allowable driving range of the motor 5 based on a load acting on the car 1, and a running distance and a running direction of the car 1 from the present position of the car 1 to the next service floor, and performs driving control of the motor 5. For example, in the case where the load acting on the car 1 is small, and the running distance to the next service floor is long, the highest speed is increased within the allowable range. Also, as another example, in the case where the running distance is short, and deceleration is required before the highest speed is reached, the running time is made short by increasing the acceleration/deceleration.

A car buffer 7 and a weight buffer 8 are installed at a bottom section of the shaft. The car buffer 7 is for preventing the car 1 from colliding into the bottom section of the shaft when the car 1 bypasses a lowest stop position for some reason or another. The car buffer 7 is arranged at an extension of an ascending/descending path of the car 1, at the bottom section of the shaft. Moreover, the weight buffer 8 is for preventing the counterweight 2 from colliding into the bottom section of the shaft when the car 1 bypasses a highest stop position for some reason or another, that is, when the counterweight 2 bypasses the lowest stop position. The weight buffer 8 is arranged at an extension of an ascending/descending path of the counterweight 2, at the bottom section of the shaft.

A governor 20 is installed at the top section of the shaft or a machine room above the shaft. The governor 20 is for causing the car 1 to make an emergency stop, by detecting that the speed of the car is at or more than a predetermined speed. A governor tension sheave 21 is installed at the bottom section of the shaft. An endless governor rope 22 is wound between a sheave of the governor 20 and the governor tension sheave 21.

Also, a safety gear device 23 is attached to the car 1. Also, a part of the governor rope 22 is coupled to the car 1 through an operation lever of the safety gear device 23.

Accordingly, when the car 1 ascends or descends, the governor rope 22 moves in coordination with the ascending/descending of the car 1. When the governor rope 22 moves, the sheave of the governor 20 is rotated. The governor 20 detects the rotation speed of the sheave, and based on the rotation speed of the sheave, constantly detects the running direction and the running speed of the car 1.

At this time, if there is slipping between the sheave of the governor 20 and the governor rope 22, the speed of the car 1 is not properly reflected in the rotation speed of the sheave of the governor 20. Accordingly, in order to prevent occurrence of slipping between the sheave of the governor 20 and the governor rope 22, the governor tension sheave 21 acts to apply appropriate tension to the governor rope 22.

The predetermined speed to be detected by the governor 20 is set based on the maximum value of the variable highest speed, that is, the maximum value within a variable range of the highest speed of the car 1. Moreover, there are two types of predetermined speeds set in the above manner, i.e. a first predetermined speed Vos and a second predetermined speed Vtr. The first predetermined speed Vos and the second predetermined speed Vtr are each set to a value greater than the maximum value of the variable highest speed, based on the maximum value of the variable highest speed. Furthermore, the second predetermined speed Vtr is set to a value greater than the first predetermined speed Vos.

When mechanically detecting that the speed of the car 1 has exceeded the first predetermined speed Vos, the governor 20 outputs, to the control device 10, a signal to the effect that the speed has been exceeded. The control device 10 shuts off a drive circuit to the motor 5 based on the signal, operates the brake 6, and electrically causes the car 1 to make an emergency stop.

Also, when mechanically detecting that the speed of the car 1 has exceeded the second predetermined speed Vtr, the governor 20 restricts movement of the governor rope 22. Then, because the car 1 and the governor rope 22 act to move relative to each other, the operation lever of the safety gear device 23 is moved, and the safety gear device 23 is operated. When the safety gear device 23 operates, a braking force in the direction of preventing descending of the car 1 is generated, and emergency braking is applied to the car 1.

An emergency terminal speed-limiting device 30 is for decelerating the car 1 by force when the speed of the car 1 within a predetermined certain distance from an upper or lower terminal end section of the shaft is determined to have reached or exceeded an overspeed reference. The emergency terminal speed-limiting device 30 monitors the speed of the car 1 which is within the certain distance from the upper or lower terminal end section of the shaft, without depending on the control device 10. Then, when the speed of the car 1 is determined to have reached or exceeded the overspeed reference, an operation command is directly output to the brake 6 without being mediated by the control device 10.

When the speed of the car 1 is detected by the emergency terminal speed-limiting device 30 to have reached or exceeded the overspeed reference, the car 1 and the counterweight 2 are decelerated by force by braking by the brake 6. This forced deceleration allows the speed of the car 1 or the counterweight 2 colliding into the car buffer 7 or the weight buffer 8 to be reduced to or below an allowable speed allowed by the corresponding buffer.

A higher speed of the car 1 means that a longer distance is required for deceleration to or below the allowable speed. Accordingly, the overspeed reference for forced deceleration by the emergency terminal speed-limiting device 30 is set according to the distance of the car 1 from the upper or lower terminal end section of the shaft. More specifically, the overspeed reference is set according to the distance of the car 1 from the upper or lower terminal end section of the shaft such that the speed of the car 1 at the time of the car 1 colliding into the car buffer 7 may be reduced to or below the allowable speed of the car buffer 7. Furthermore, the same thing can be said for the counterweight 2, and the overspeed reference is set according to the distance of the car 1 from the upper or lower terminal end section of the shaft such that the speed of the counterweight 2 at the time of the counterweight 2 colliding into the weight buffer 8 may be reduced to or below the allowable speed of the weight buffer 8.

Additionally, as described above, because the car 1 and the counterweight 2 are coupled by the main rope 3, the car 1 and the counterweight 2 run in the opposite directions from each other at the same speed. Accordingly, if the position and the speed of the car 1 are grasped, the position and the speed of the counterweight 2 can be grasped. Therefore, in this case, it is assumed that the position and the speed of the counterweight 2 are determined from the position and the speed of the car 1. However, it is needless to say that the position and the speed of the counterweight 2 may be directly determined.

Next, an example of the overspeed reference (Vets) will be described with reference to FIG. 2. In FIG. 2, the horizontal axis is a position (x) of the car 1, and indicates the distance of the car 1 from the upper or lower terminal end section of the shaft. Also, the vertical axis is the speed. In FIG. 2, three example settings of the overspeed reference (Vets) are shown. Each overspeed reference (Vets) may be expressed as a function of the position (x) of the car 1.

In any of the example settings, the overspeed reference (Vets) becomes equal to the allowable speed of the car buffer 7 at the position where the car 1 collides into the car buffer 7. Also, the overspeed reference (Vets) is set to be increased as the position (x) of the car 1 gets farther away from the car buffer 7, that is, as the distance of the car 1 from the terminal end section of the shaft is increased. Conversely, the overspeed reference (Vets) is set to be reduced as the distance (x) of the car 1 from the upper or lower end section of the shaft is reduced.

However, the overspeed reference (Vets) is not to exceed the first predetermined speed Vos of the governor 20. That is, the overspeed reference (Vets) draws a smooth curve that nears the first predetermined speed Vos as the distance of the car 1 from the terminal end section of the shaft is increased. In any of the example settings, the maximum value of the overspeed reference (Vets) is equal to the first predetermined speed Vos.

The optimal setting among the settings of the relationship between Vets and x as shown in FIG. 2 is selected and used, based on the specifications of the elevator, as the overspeed reference to be actually used by the emergency terminal speed-limiting device 30 for overspeed determination.

Specifically, for an elevator with the specifications where the deceleration of whose car 1 at the time of braking by the brake 6 is relatively great, the overspeed reference (Vets) whose value radically changes relative to the position (x) of the car 1 is selected; in other words, the overspeed reference (Vets) whose track is arranged more on the terminal end section side of the shaft in the graph in FIG. 2 is selected. Conversely, for an elevator with the specifications where the deceleration of whose car 1 at the time of braking by the brake 6 is relatively small, the overspeed reference (Vets) whose value gradually changes relative to the position (x) of the car 1 is selected; in other words, the overspeed reference (Vets) whose track is arranged more on the intermediate floor side of the shaft in the graph in FIG. 2 is selected.

Furthermore, in the case where the car buffer 7 and the weight buffer 8 with longer buffer strokes are used, the overspeed reference (Vets) whose value radically changes relative to the position (x) of the car 1 is selected; in other words, the overspeed reference (Vets) whose track is arranged more on the terminal end section side of the shaft in the graph in FIG. 2 is selected. Conversely, in the case where the car buffer 7 and the weight buffer 8 with shorter buffer strokes are used, the overspeed reference (Vets) whose value gradually changes relative to the position (x) of the car 1 is selected; in other words, the overspeed reference (Vets) whose track is arranged more on the intermediate floor side of the shaft in the graph in FIG. 2 is selected.

That is, with specifications which allow the speed of collision into the buffer to be easily reduced to or below the allowable speed, the selected overspeed reference (Vets) is the overspeed reference (Vets) whose value radically changes relative to the position (x) of the car 1, and whose track is arranged more on the terminal end section side of the shaft in the graph in FIG. 2. On the other hand, with specifications by which reduction of the speed of collision into the buffer to or below the allowable speed is difficult, the selected overspeed reference (Vets) is the overspeed reference (Vets) whose value gradually changes relative to the position (x) of the car 1, and whose track is arranged more on the intermediate floor side of the shaft in the graph in FIG. 2.

The relationship between an overspeed reference (Vets) selected and set in the above manner and the position (x) of the car 1 is stored in advance in the emergency terminal speed-limiting device 30. At this time, it is sufficient if the emergency terminal speed-limiting device 30 stores the relationship between the position (x) of the car 1 and one overspeed reference (Vets) according to the specifications of the elevator to which the emergency terminal speed-limiting device 30 is to be applied.

However, the relationships between the position (x) of the car 1 and a plurality of overspeed references (Vets) shown in FIG. 2 may alternatively be stored in advance in the emergency terminal speed-limiting device 30. In this case, at the time of installation of the emergency terminal speed-limiting device 30, a worker selects and sets the relationship between the optimal overspeed reference (Vets) and the position (x) of the car 1 based on the specifications of the elevator where the emergency terminal speed-limiting device 30 is installed. This allows the emergency terminal speed-limiting device 30 to be applied to elevators of different specifications.

Description will be further given with reference to FIG. 1. A shaft switch 31 on the upper end side and a shaft switch 32 on the lower end side are installed in the shaft. The shaft switch 31 on the upper end side is for detecting that the car 1 has approached within the certain distance from the terminal end section on the upper side of the shaft. A switch rail 33 is attached to the car 1. When the car 1 reaches a position at the certain distance from the terminal end section on the upper side of the shaft, the switch rail 33 contacts the shaft switch 31 on the upper end side to open or close the shaft switch 31 on the upper end side.

Also, the shaft switch 32 on the lower end side is for detecting that the car 1 has approached within the certain distance from the terminal end section on the lower side of the shaft. When the car 1 reaches a position at the certain distance from the terminal end section on the lower side of the shaft, the switch rail 33 contacts the shaft switch 32 on the lower end side to open or close the shaft switch 32 on the lower end side.

The emergency terminal speed-limiting device 30 may detect that the car 1 has passed a position at the certain distance from the upper or lower terminal end section of the shaft based on an open/close signal of the shaft switch 31 on the upper end side or the shaft switch 32 on the lower end side. Additionally, to reliably detect the car 1 approaching the terminal end section, a switch including a positive separation mechanism is desirably used as the shaft switch 31 on the upper end side and the shaft switch 32 on the lower end side.

An encoder 34 is provided to the governor 20. The encoder 34 outputs a detection signal according to the amount of rotation or the rotation speed of the sheave of the governor 20. As described above, rotation of the sheave of the governor 20 is in accordance with running of the car 1. Accordingly, the running distance of the car 1 is reflected in the amount of rotation of the sheave of the governor 20.

The emergency terminal speed-limiting device 30 first specifies a time point of the car 1 passing the position at the certain distance from the upper or lower terminal end section of the shaft based on the signal from the shaft switch 31 on the upper end side or the shaft switch 32 on the lower end side. Next, the emergency terminal speed-limiting device 30 calculates the amount of movement of the car 1 after the time point from the detection signal of the encoder 34. Then, the emergency terminal speed-limiting device 30 calculates the position (x) of the car 1 from the terminal end section based on the amount of movement after the car 1 has passed the position at the certain distance from the terminal end section. The emergency terminal speed-limiting device 30 may thus determine the position (x) of the car 1 at an arbitrary time point after the car 1 has passed the position at the certain distance from the upper or lower terminal end section of the shaft.

Specifically, the emergency terminal speed-limiting device 30 determines the present position of the car 1 with respect to the position of collision of the car 1 into the car buffer 7 by using the signal from the shaft switch 31 on the upper end side and the detection signal from the encoder 34. In the same manner, the emergency terminal speed-limiting device 30 determines the present position of the car 1 with respect to the position of the car 1 when the counterweight 2 is at a position of colliding into the weight buffer 8, by using the signal from the shaft switch 32 on the lower end side and the detection signal from the encoder 34.

Then, the emergency terminal speed-limiting device 30 determines the value of the overspeed reference (Vets) to be used for determination at the time point from the relationship of the overspeed reference (Vets) and the position (x) of the car 1 stored in advance and the present position (x) of the car 1 determined in the above manner. Also, the emergency terminal speed-limiting device 30 calculates the speed of the car 1 at the time point by arithmetically processing the detection signal from the encoder 34. Next, the emergency terminal speed-limiting device 30 compares the speed of the car 1 at the time point and the overspeed reference (Vets) to be used for determination at the time point. Then, if the speed of the car 1 at the time point is at or exceeding the overspeed reference (Vets) used for determination at the time point, the speed of the car 1 is detected to be at or exceeding the overspeed reference (Vets).

When the speed of the car 1 is detected to be at or exceeding the overspeed reference (Vets), the emergency terminal speed-limiting device 30 directly outputs an operation command to the brake 6 as described above. The brake 6 operates upon reception of the operation command, and causes the car 1 to decelerate by force.

Additionally, in the case where the car 1 is approaching the terminal end section on the upper side and the counterweight 2 is approaching the terminal end section on the lower side, the distance between the counterweight 2 and the weight buffer 8 may be grasped from the position of the car 1, or may be grasped by directly detecting the position of the counterweight 2.

The emergency terminal speed-limiting device 30 and the control device 10 are connected in a manner capable of communication. The emergency terminal speed-limiting device 30 transmits information, stored in itself, about the relationship between the presently selected overspeed reference (Vets) and the position (x) of the car 1 to the control device 10.

A lower deceleration limit determination unit 11 and a deceleration control unit 12 are provided to the control device 10. The lower deceleration limit determination unit 11 determines a lower deceleration limit (Dets) at which the speed of the car 1 is caused to be at or below the overspeed reference (Vets), based on the position and the speed of the car 1 which is within the certain distance from the upper or lower terminal end section of the shaft.

That is, first, the lower deceleration limit determination unit 11 acquires information about the relationship between the overspeed reference (Vets) and the position (x) of the car 1 transmitted from the emergency terminal speed-limiting device 30. Next, when the car 1 enters within the certain distance from the upper or lower terminal end section of the shaft, the lower deceleration limit determination unit 11 determines, from the position and the speed of the car 1 at the present time point, the minimum deceleration by which the speed of the car 1 does not exceed the overspeed reference (Vets) from the present time point until the car 1 stops at the terminal floor, and determines the minimum deceleration determined to be the lower deceleration limit (Dets).

The value of the lower deceleration limit (Dets) may change according to the position (x) of the car 1. That is, the lower deceleration limit (Dets) may be determined as the function of the position (x) of the car 1. Alternatively, the lower deceleration limit (Dets) may take a constant value regardless of the position (x) of the car 1.

Additionally, determination of the lower deceleration limit (Dets) by the lower deceleration limit determination unit 11 is performed when the next service floor of the car 1 is the terminal floor (the top floor or the bottom floor). Moreover, the lower deceleration limit determination unit 11 may perform the determination from before the car 1 approaches within the certain distance from the terminal end section of the shaft.

The deceleration control unit 12 controls the deceleration of the car 1 which is within the certain distance from the terminal end section of the shaft, in a range greater than the lower deceleration limit (Dets) determined by the lower deceleration limit determination unit 11 in the above manner. Additionally, to be precise, the "range greater than the lower deceleration limit (Dets)" means a range in which the absolute value of deceleration is greater than the deceleration of the lower deceleration limit (Dets).

As described above, the control device 10 sets each of the highest speed and the acceleration/deceleration of the car 1 to an optimal value within the allowable driving range of the motor 5 based on a load acting on the car 1, and the running distance and the running direction of the car 1 from the present position of the car 1 to the next service floor, and performs driving control of the motor 5. At this time, if the next service floor is the terminal floor, the control device 10 performs driving control of the motor 5 according to the deceleration controlled by the deceleration control unit 12, especially after the car 1 enters within the certain distance from the terminal end section of the shaft.

That is, after the car 1 enters within the certain distance from the terminal end section of the shaft, the control device 10 causes the car 1 to decelerate at the optimal deceleration in the range greater than the lower deceleration limit (Dets), and causes the car 1 to stop at the terminal floor. Accordingly, the car 1 may be stopped at the terminal floor while maintaining a state where the speed of the car 1 does not reach or exceed the overspeed reference (Vets) of the emergency terminal speed-limiting device 30, with no particular limit set on the highest speed of the car 1.

The elevator device configured in the above manner includes the car 1 and the counterweight 2 that ascend or descend in the shaft of the elevator in opposite directions from each other, the control device 10 which is control means for controlling ascending/descending of the 1 car at the variable highest speed and the variable acceleration/deceleration allowing a highest speed and an acceleration/deceleration at the time of running of the car 1 to be changed, the car buffer 7, provided at the bottom section of the shaft, for preventing the car 1 from colliding into the bottom section, the weight buffer 8, provided at the bottom section of the shaft, for preventing the counterweight 2 from colliding into the bottom section, and the emergency terminal speed-limiting device 30 which is emergency terminal speed-limiting means for decelerating the car by force when the speed of the car 1 within the predetermined certain distance from the upper or lower terminal end section of the shaft is detected to have reached or exceeded the overspeed reference.

Moreover, the overspeed reference is set to be smaller as the distance of the car 1 from the upper or lower terminal end section of the shaft is shorter, and the control device 10 includes the lower deceleration limit determination unit 11 which is lower deceleration limit determination means for determining the lower deceleration limit at which the speed of the car 1 is caused to be at or below the overspeed reference, based on the position and the speed of the car 1 which is within the certain distance from the upper or lower terminal end section of the shaft, and the deceleration control unit 12 which is deceleration control means for controlling the deceleration of the car 1 which is within the certain distance from the upper or lower terminal end section of the shaft, in a range greater than the lower deceleration limit determined by the lower deceleration limit determination unit 11.

Accordingly, the car may be stopped at the terminal floor while maintaining a state where the speed of the car does not reach or exceed the overspeed reference which is reduced as the terminal end gets closer, with no particular limit set on the highest speed of the car running at the terminal end section of the shaft toward the terminal floor (the top floor or the bottom floor), and application of a buffer having a buffer stroke is enabled.

Accordingly, an effect that reduction in the operational efficiency and the convenience may be suppressed, and an effect that an increase in the space occupied by the elevator device in a building may be suppressed may both be achieved.

Moreover, there is provided the governor 20 for detecting that the speed of the car is at or exceeding the predetermined speed which is set based on the maximum value of the variable highest speed, and the variable range of the highest speed and the variable range of the acceleration/deceleration of the car may be maximized by making the maximum value of the overspeed reference equal to the predetermined speed, and this may lead to improved service.

Furthermore, because main functions for suppressing the speed of the car at the terminal end section of the shaft to or below the allowable speed of the buffer are integrated in the emergency terminal speed-limiting device, the reliability may be secured at a low cost.

Second Embodiment

Figure 3:
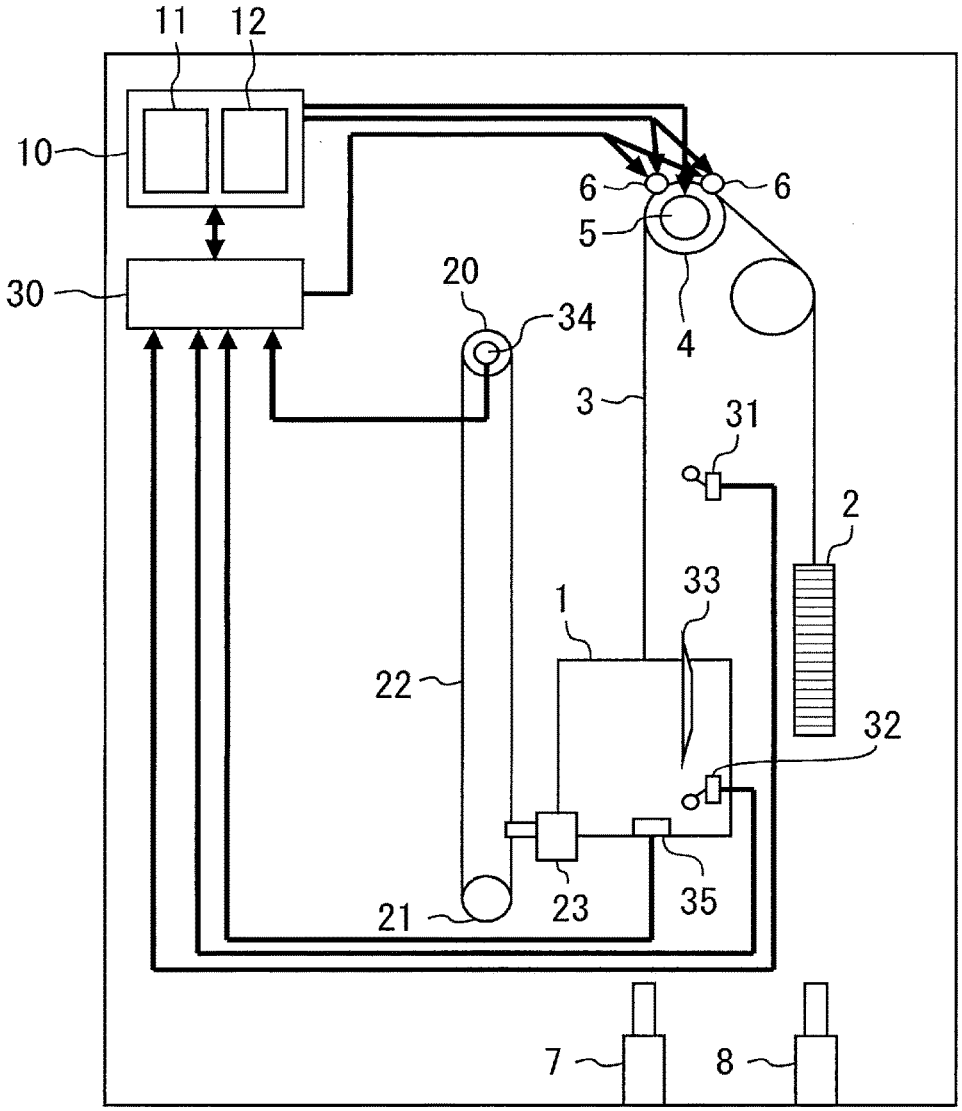
FIG. 3 is a diagram schematically showing the overall configuration of an elevator device related to a second embodiment of the present invention.

FIG. 3 is related to a second embodiment of the present invention, and is a diagram schematically showing the overall configuration of an elevator device.

The second embodiment described here is the configuration of the first embodiment described above, but the emergency terminal speed-limiting device 30 is to set the overspeed reference (Vets) in such a way that the speed of the car or the counterweight colliding into the buffer is reduced to or below the allowable speed according to the load on the car and the distance of the car 1 from the terminal end section of the shaft.

As shown in FIG. 3, in the second embodiment, a load weighing device 35 is provided to the car 1. The load weighing device 35 is car load detection means for detecting a load on the car 1. A signal of the load on the car 1 detected by the load weighing device 35 is input to the emergency terminal speed-limiting device 30.

Specifications of an elevator to which the emergency terminal speed-limiting device 30 is to be applied are stored in advance as parameters in the emergency terminal speed-limiting device 30. Specifically, parameters that are input are the rated loading mass of the car 1, inertia of a movable section of the entire system, allowable collision speed of the car buffer 7 and the weight buffer 8, the braking performance of the brake 6, and the like. Also, the relationships between the position (x) of the car 1 and a plurality of overspeed references (Vets) as illustrated in FIG. 2 for the first embodiment are stored in advance in the emergency terminal speed-limiting device 30.

The emergency terminal speed-limiting device 30 sets the overspeed reference (Vets) according to the load on the car 1 detected by the load weighing device 35 and the distance (x) of the car 1 from the upper or lower terminal end section of the shaft in such a way that the speed of the car 1 at the time of the car 1 colliding into the car buffer 7 may be reduced to or below the allowable speed and the speed of the counterweight 2 at the time of the counterweight 2 colliding into the weight buffer 8 may be reduced to or below the allowable speed.

Setting of the overspeed reference (Vets) will be described in greater detail. First, the emergency terminal speed-limiting device 30 calculates the deceleration of the car 1 caused at the time of operation of the brake 6, by using the parameters stored in advance and a detection signal for the load on the car 1 from the load weighing device 35. This deceleration is the forced deceleration at the time of the emergency terminal speed-limiting device 30 detecting that the speed of the car 1 is at the overspeed reference (Vets).

Next, based on the calculated deceleration, the emergency terminal speed-limiting device 30 selects from the relationships between the position (x) of the car 1 and a plurality of overspeed references (Vets) that are stored in advance, the relationship between the position (x) of the car 1 and the overspeed reference (Vets) with the greatest overspeed reference value among those allowing the speed of the car 1 at the time of the car 1 colliding into the car buffer 7 to be reduced to or below the allowable speed.

In the same manner, based on the calculated deceleration, the emergency terminal speed-limiting device 30 selects from the relationships between the position (x) of the car 1 and a plurality of overspeed references (Vets) that are stored in advance, the relationship between the position (x) of the car 1 and the overspeed reference (Vets) with the greatest overspeed reference value among those allowing the speed of the counterweight 2 at the time of the counterweight 2 colliding into the weight buffer 8 to be reduced to or below the allowable speed.

Then, the emergency terminal speed-limiting device 30 determines the value of the overspeed reference (Vets) to be used for determination at the present time point from the relationships of the position (x) of the car 1 and the overspeed references (Vets) selected in the above manner and the present position (x) of the car 1. Next, the emergency terminal speed-limiting device 30 compares the speed of the car 1 at the present time point and the overspeed reference (Vets) to be used for determination at the present time point. Then, if the speed of the car 1 at the time point is at or exceeding the overspeed reference (Vets) used for determination at the time point, the speed of the car 1 is detected to be at or exceeding the overspeed reference (Vets).

When the speed of the car 1 is detected to be at or exceeding the overspeed reference (Vets), the emergency terminal speed-limiting device 30 directly outputs an operation command to the brake 6 as described above. The brake 6 operates upon reception of the operation command, and causes the car 1 to decelerate by force.

Then, the emergency terminal speed-limiting device 30 transmits information about the relationship between the presently selected overspeed reference (Vets) and the position (x) of the car 1 as described above to the control device 10. Then, as in the first embodiment, the lower deceleration limit determination unit 11 determines the lower deceleration limit (Dets) at which the speed of the car 1 is caused to be at or below the presently selected overspeed reference (Vets), based on the position and the speed of the car 1 which is within the certain distance from the upper or lower terminal end section of the shaft. Also, the deceleration control unit 12 controls the deceleration of the car 1 which is within the certain distance from the terminal end section of the shaft, in a range greater than the lower deceleration limit (Dets) determined by the lower deceleration limit determination unit 11.

Additionally, other configurations are the same as in the first embodiment, and detailed description thereof is omitted.

The elevator device configured in the above manner may achieve the same effects as those in the first embodiment, and moreover, the reference for the overspeed to be detected by the emergency terminal speed-limiting device 30 may be appropriately set according to a change in the load on the car 1. Accordingly, the range of deceleration that can be set at the time of deceleration toward the terminal floor may be increased for the control of the variable acceleration/deceleration, and thus, a high level of service may be achieved while miniaturizing the buffers and reducing the space in the pit at the bottom section of the shaft.

INDUSTRIAL APPLICABILITY

The present invention is applicable to an elevator device which controls ascending/descending of a car at a variable highest speed and a variable acceleration/deceleration allowing a highest speed and an acceleration/deceleration at the time of running of the car to be changed, which includes buffers at the bottom section of a shaft, and which includes emergency terminal speed-limiting means for decelerating the car by force when the speed of the car within a predetermined certain distance from a terminal end section of the shaft is detected to have reached or exceeded an overspeed reference.

REFERENCE SIGNS LIST

1 Car, 2 Counterweight, 3 Main rope, 4 Traction machine, 5 Motor, 6 Brake, 7 Car buffer, 8 Weight buffer, 10 Control device, 11 Lower deceleration limit determination unit, 12 Deceleration control unit, 20 Governor, 21 Governor tension sheave, 22 Governor rope, 23 Safety gear device, 30 Emergency terminal speed-limiting device, 31 Shaft switch on the upper end side, 32 Shaft switch on the lower end side, 33 Switch rail, 34 Encoder, 35 Load weighing device

The invention claimed is:

1. An elevator device comprising:

a car and a counterweight that ascend or descend in a shaft of an elevator in opposite directions from each other;

a control device configured to control ascending/descending of the car at a variable highest speed and a variable acceleration/deceleration allowing a highest speed and an acceleration/deceleration at a time of running of the car to be changed;

a car buffer provided at a bottom section of the shaft, the car buffer configured to prevent the car from colliding into the bottom section;

a weight buffer provided at the bottom section of the shaft, the weight buffer configured to prevent the counterweight from colliding into the bottom section; and an emergency terminal speed-limiting device configured to decelerate the car by force when a speed of the car within a predetermined certain distance from an upper or lower terminal end section of the shaft is detected to have reached or exceeded an overspeed reference, wherein the overspeed reference is reduced as a distance of the car from the upper or lower terminal end section of the shaft becomes shorter, and wherein the control device includes:

a lower deceleration limit determination device configured to determine a lower deceleration limit at which the speed of the car is caused to be at or below the overspeed reference, based on a position and a speed of the car within the certain distance from the upper or lower terminal end section of the shaft, and a deceleration control device configured to control deceleration of the car within the certain distance from the upper or lower terminal end section of the shaft, in a range greater than the lower deceleration limit determined by the lower deceleration limit determination device.

2. The elevator device according to claim 1, comprising a governor configured to detect that the speed of the car is at or exceeding a predetermined speed, the predetermined speed set based on a maximum value of the variable highest speed, wherein a maximum value of the overspeed reference is equal to the predetermined speed.

3. The elevator device according to claim 1, wherein the overspeed reference is set according to a distance of the car from the upper or lower terminal end section of the shaft in such a way that a speed of the car at a time of the car colliding into the car buffer is reduced to or below an allowable speed and a speed of the counterweight at a time of the counterweight colliding into the weight buffer is reduced to or below an allowable speed.

4. The elevator device according to claim 1, comprising a load weighing device configured to detect a load on the car, wherein the emergency terminal speed-limiting unit sets the overspeed reference according to the load on the car detected by the load weighing device and a distance of the car from the upper or lower terminal end section of the shaft in such a way that a speed of the car at a time of the car colliding into the car buffer is reduced to or below an allowable speed and a speed of the counterweight at a time of the counterweight colliding into the weight buffer is reduced to or below an allowable speed.

5. The elevator device according to claim 2, wherein the overspeed reference is set according to a distance of the car from the upper or lower terminal end section of the shaft in such a way that a speed of the car at a time of the car colliding into the car buffer is reduced to or below an allowable speed and a speed of the counterweight at a time of the counterweight colliding into the weight buffer is reduced to or below an allowable speed.

6. The elevator device according to claim 2, comprising a load weighing device configured to detect a load on the car, wherein the emergency terminal speed-limiting unit sets the overspeed reference according to the load on the car detected by the load weighing device and a distance of the car from the upper or lower terminal end section of the shaft in such a way that a speed of the car at a time of the car colliding into the car buffer is reduced to or below an allowable speed and a speed of the counterweight at a time of the counterweight colliding into the weight buffer is reduced to or below an allowable speed.

* * * * *